US006385572B2

(12) United States Patent
Hu

(10) Patent No.: US 6,385,572 B2
(45) Date of Patent: May 7, 2002

(54) SYSTEM AND METHOD FOR EFFICIENTLY IMPLEMENTING A MASKING FUNCTION IN A PSYCHO-ACOUSTIC MODELER

(75) Inventor: Fengduo Hu, Milpitas, CA (US)

(73) Assignees: Sony Corporation, Tokyo (JP); Sony Electronics Inc., Park Ridge, NJ (US)

( * ) Notice: Subject to any disclaimer, the term of this patent is extended or adjusted under 35 U.S.C. 154(b) by 0 days.

(21) Appl. No.: 09/738,069

(22) Filed: Dec. 14, 2000

Related U.S. Application Data

(63) Continuation of application No. 09/150,117, filed on Sep. 9, 1998, now Pat. No. 6,195,633.

(51) Int. Cl.[7] ..... G10L 19/00
(52) U.S. Cl. ..... 704/200.1
(58) Field of Search ..... 704/200.1, 206; 375/243

(56) References Cited

U.S. PATENT DOCUMENTS 5,963,596 A * 10/1999 Benbassat et al. ..... 375/243
6,041,295 A * 3/2000 Hinderks ..... 704/206

* cited by examiner

*Primary Examiner*—David D. Knepper
(74) *Attorney, Agent, or Firm*—Gregory J. Koerner; Simon & Koerner LLP

(57) ABSTRACT

A system comprises a refined psycho-acoustic modeler for efficient perceptive encoding compression of digital audio. Perceptive encoding uses experimentally derived knowledge of human hearing to compress audio by deleting data corresponding to sounds which will not be perceived by the human ear. A psycho-acoustic modeler produces masking information that is used in the perceptive encoding system to specify which amplitudes and frequencies may be safely ignored without compromising sound fidelity. The present invention includes a system and method for efficiently implementing a masking function in a psycho-acoustic modeler in digital audio perceptive encoding. In the preferred embodiment, the present invention comprises a non-logarithmically based representation of individual masking functions utilizing minimally-sized look-up tables.

42 Claims, 12 Drawing Sheets

SYSTEM AND METHOD FOR EFFICIENTLY IMPLEMENTING A MASKING FUNCTION IN A PSYCHO-ACOUSTIC MODELER

CROSS-REFERENCE TO RELATED APPLICATIONS

This application is a continuation, and claims priority in, U.S. patent application Ser. No. 09/150,117, entitled "System and Method For Implementing A Masking Function In A Psycho-Acoustic Modeler," filed on Sep. 9, 1998, now U.S. Pat. No. 6,195,633 issued Feb. 27, 2001.

BACKGROUND OF THE INVENTION

1. Field of the Invention

This invention relates generally to improvements in digital audio processing and specifically to a system and method for efficiently implementing a masking function in a psycho-acoustic modeler in digital audio encoding.

2. Description of the Background Art

Digital audio is now in widespread use in audio and audiovisual systems. Digital audio is used in compact disk (CD) players, digital video disk (DVD) players, digital video broadcast (DVB), and many other current and planned systems. The ability of all these systems to present large amounts of audio is limited by either storage capacity or bandwidth, which may be viewed as two aspects of a common problem. In order to fit more digital audio in a storage device of limited storage capacity, or to transmit digital audio over a channel of limited bandwidth, some form of digital audio compression is required.

Due to the structure of audio signals and the human ear's sensitivity to sound, many of the usual data compression schemes have been shown to yield poor results when applied to digital audio. An exception to this is perceptive encoding, which uses experimentally determined information about human hearing from what is called psycho-acoustic theory. The human ear does not perceive sound frequencies evenly. Research has determined that there are 25 non-linearly spaced frequency bands, called critical bands, to which the ear responds. Furthermore, this research shows experimentally that the human ear cannot perceive tones whose amplitude is below a frequency-dependent threshold, or tones that are near in frequency to another, stronger tone. Perceptive encoding exploits these effects by first converting digital audio from the time-sampled domain to the frequency-sampled domain, and then by choosing not to allocate data to those sounds which would not be perceived by the human ear. In this manner, digital audio may be compressed without the listener being aware of the compression. The system component that determines which sounds in the incoming digital audio stream may be safely ignored is called a psycho-acoustic modeler.

Two examples of applications of perceptive encoding of digital audio are those given by the Motion Picture Experts Group (MPEG) in their audio and video specifications, and by Dolby Labs in their Audio Compression 3 (AC-3) specification. The MPEG specification will be examined in detail, although much of the discussion could also apply to AC-3. A standard decoder design for digital audio is given in the MPEG specifications, which allows all MPEG encoded digital audio to be reproduced by differing vendors' equipment. Certain parts of the encoder design must also be standard in order that the encoded digital audio may be reproduced with the standard decoder design. However, the psycho-acoustic modeler, and its method of calculating individual masking functions, may be changed without affecting the ability of the resulting encoded digital audio to be reproduced with the standard decoder design.

In some implementations, the psycho-acoustic modeler calculates the individual masking functions by adding together psycho-acoustic model components expressed in decibels (dB). These psycho-acoustic model components, expressed in dB, are logarithmic components, and therefore the logarithms of any newly measured quantities must be derived. Derivation of the logarithms of measured quantities may be performed by using a look-up table, or, alternatively, by direct calculation. Neither of these methods possess utility when used with the preferred data processing equipment: a digital signal processor (DSP) microprocessor executing code written in assembly language. The size of the look-up table would be excessive when used with the broad range of signal values anticipated. Similarly, the calculation of transcendental functions such as logarithms is inconvenient to code in assembly language. Therefore, there exists a need for an efficient implementation of a masking function in a psycho-acoustic modeler for use in consumer digital audio products.

SUMMARY OF THE INVENTION

The present invention includes a system and method for a refined psycho-acoustic modeler in digital audio perceptive encoding. Perceptive encoding uses experimentally derived knowledge of human hearing to compress audio by deleting data corresponding to sounds which will not be perceived by the human ear. A psycho-acoustic modeler produces masking information that is used in the perceptive encoding system to specify which amplitudes and frequencies may be safely ignored without compromising sound fidelity. In the preferred embodiment, the present invention comprises a system and method for efficiently implementing a masking function in a psycho-acoustic modeler in digital audio encoding.

The present invention includes a refined approximation to the experimentally-derived individual masking spread function, which allows superior performance when used to calculate the overall amplitudes and frequencies which may be ignored during compression. The present invention may be used whether the maskers are tones or noise. In the preferred embodiment of the present invention, the parameters of the individual masking functions are expressed and stored in linear representations, rather than expressed in decibels and stored in logarithmic representations. In order to more efficiently calculate the individual masking functions, some of these parameters are stored in look-up tables. This eliminates the necessity of extracting the logarithms of masker amplitudes and thus enhances performance when programming in assembly language for a digital signal processor (DSP) microprocessor.

In the preferred embodiment, the initial offsets from the signal strength, called mask index functions, are directly stored in look-up tables. The dependencies of the individual masking functions at frequencies away from the masker central frequency, called spread functions, are calculated from components stored in look-up tables.

DETAILED DESCRIPTION OF THE PREFERRED EMBODIMENT

The present invention relates to an improvement in digital signal processing. The following description is presented to enable one of ordinary skill in the art to make and use the invention and is provided in the context of a patent application and its requirements. The present invention is specifically disclosed in the environment of digital audio perceptive encoding in Motion Picture Experts Group (MPEG) format, performed in a coder/decoder (CODEC) integrated circuit. However, the present invention may be practiced wherever the necessity for psycho-acoustic modeling in perceptive encoding occurs. Various modifications to the preferred embodiment will be readily apparent to those skilled in the art and the generic principles herein may be applied to other embodiments. Thus, the present invention is not intended to be limited to the embodiment shown, but is to be accorded the widest scope consistent with the principles and features described herein.

In the preferred embodiment, the present invention comprises an efficient implementation of an individual masking function in a psycho-acoustic modeler in digital audio encoding. Perceptive encoding compresses audio data through an application of experimentally-derived knowledge of human hearing by deleting data corresponding to sounds which will not be perceived by the human ear. A psycho-acoustic modeler produces masking information that is used in the perceptive encoding system to specify which amplitudes and frequencies may be safely ignored without compromising sound fidelity. The present invention includes a system and method for efficiently implementing individual masking functions in a psycho-acoustic modeler. In the preferred embodiment, the present invention comprises a linear (non-logarithmic) representation of individual masking functions utilizing minimally-sized look-up tables.

Figure 1:
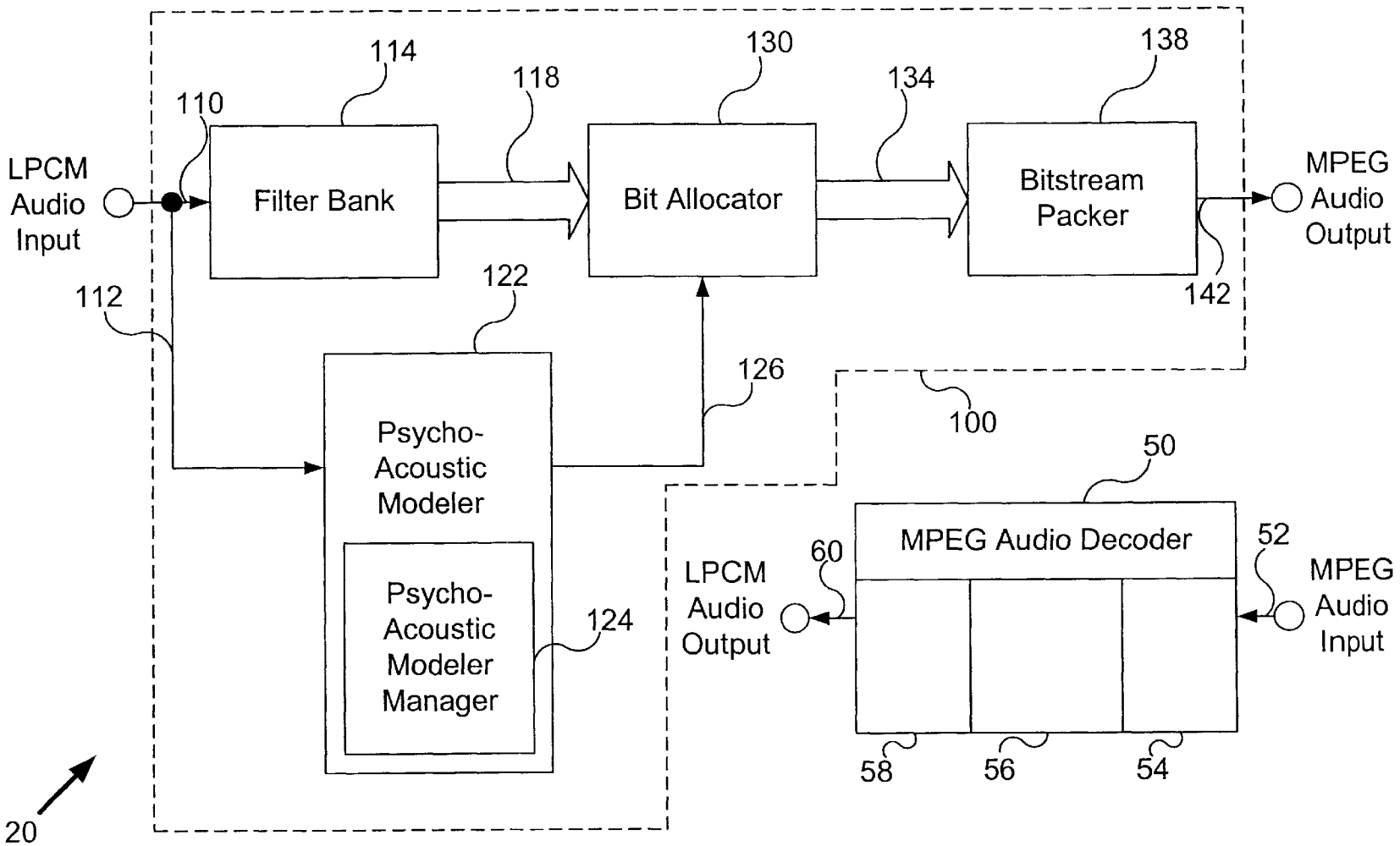
FIG. 1 is a block diagram of one embodiment of an MPEG audio encoding/decoding circuit, in accordance with the present invention.

Referring now to FIG. 1, a block diagram of one embodiment of an MPEG audio encoding/decoding (CODEC) circuit 20 is shown, in accordance with the present invention. MPEG CODEC 20 comprises MPEG audio decoder 50 and MPEG audio encoder 100. Usually MPEG audio decoder 50 comprises a bitstream unpacker 54, a frequency sample reconstructor 56, and a filter bank 58. In the preferred embodiment, MPEG audio encoder 100 comprises a filter bank 114, a bit allocator 130, a psycho-acoustic modeler 122, and a bitstream packer 138.

In the FIG. 1 embodiment, MPEG audio encoder 100 converts uncompressed linear pulse-code modulated (LPCM) audio into compressed MPEG audio. LPCM audio consists of time-domain sampled audio signals, and in the preferred embodiment consists of 16-bit digital samples arriving at a sample rate of 48 KHz. LPCM audio enters MPEG audio encoder 100 on LPCM audio signal line 110. Filter bank 114 converts the single LPCM bitstream into the frequency domain in a number of individual frequency sub-bands.

The frequency sub-bands approximate the 25 critical bands of psycho-acoustic theory. This theory notes how the human ear perceives frequencies in a non-linear manner. To more easily discuss phenomena concerning the non-linearly spaced critical bands, the unit of frequency denoted a "Bark" is used, where one Bark (named in honor of the acoustic physicist Barkhausen) equals the width of a critical band. For frequencies below 500 Hz, one Bark is approximately the frequency divided by 100. For frequencies above 500 Hz, one Bark is approximately 9+4 log(frequency/1000).

In the MPEG standard model, 32 sub-bands are selected to approximate the 25 critical bands. In other embodiments of digital audio encoding and decoding, differing numbers of sub-bands may be selected. Filter bank 114 preferably comprises a 512 tap finite-duration impulse response (FIR) filter. This FIR filter yields on digital sub-bands 118 an uncompressed representation of the digital audio in the frequency domain separated into the 32 distinct sub-bands.

Bit allocator 130 acts upon the uncompressed sub-bands by determining the number of bits per sub-band that will represent the signal in each sub-band. It is desired that bit allocator 130 allocate the minimum number of bits per sub-band necessary to accurately represent the signal in each sub-band.

To achieve this purpose, MPEG audio encoder 100 includes a psycho-acoustic modeler 122 which supplies information to bit allocator 130 regarding masking thresholds via threshold signal output line 126. These masking thresholds are further described below in conjunction with FIGS. 2 through 8 below. In the preferred embodiment of the present invention, psycho-acoustic modeler 122 comprises a software component called a psycho-acoustic modeler manager 124. When psycho-acoustic modeler manager 124 is executed it performs the functions of psycho-acoustic modeler 122.

After bit allocator 130 allocates the number of bits to each sub-band, each sub-band may be represented by fewer bits to advantageously compress the sub-bands. Bit allocator 130 then sends compressed sub-band audio 134 to bitstream packer 138, where the sub-band audio data is converted into MPEG audio format for transmission on MPEG compressed audio 142 signal line.

Figure 2:
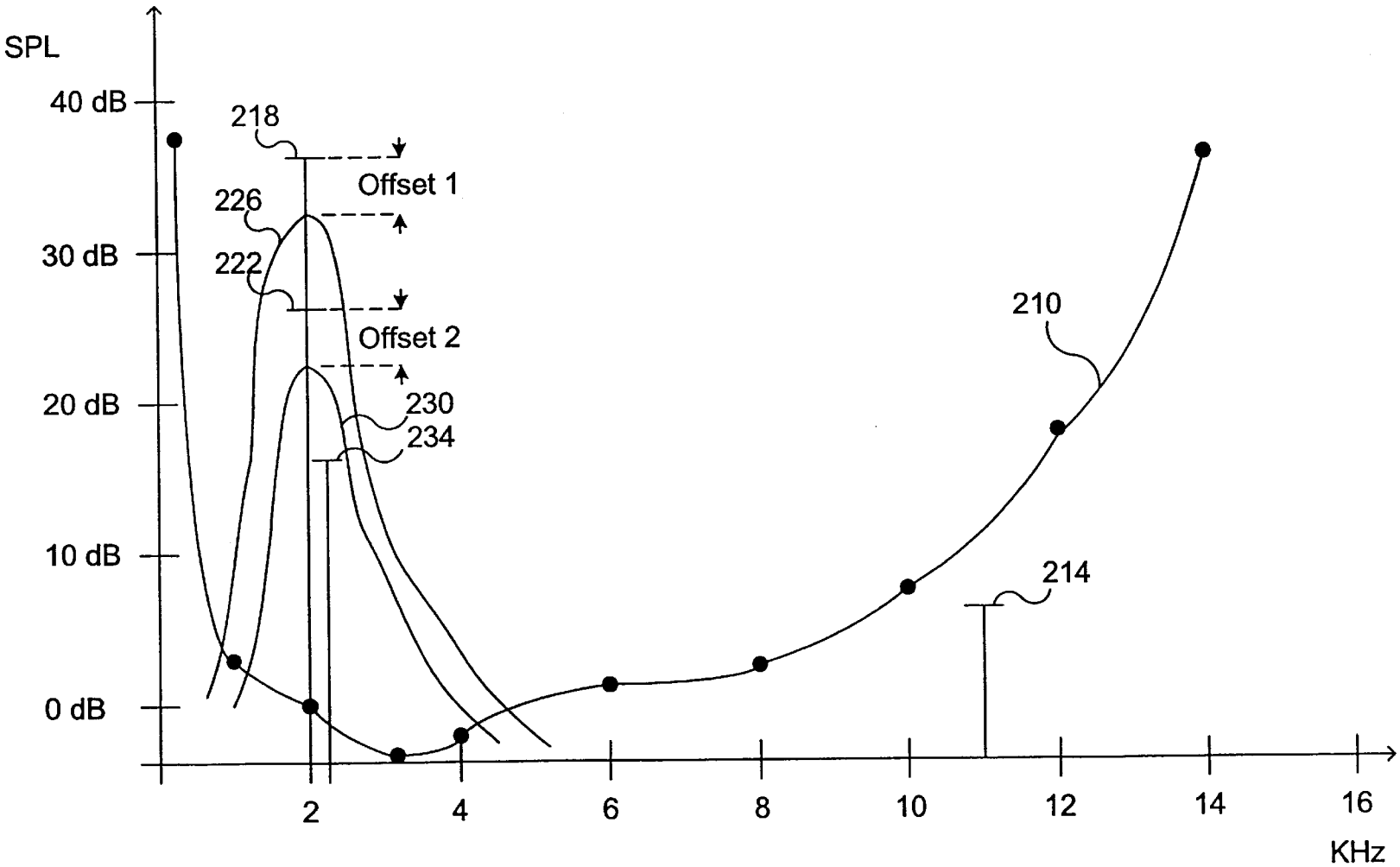
FIG. 2 is a graph showing basic psycho-acoustic concepts.

Referring now to FIG. 2, a graph illustrating basic psycho-acoustic concepts is shown. Frequency in kilohertz is displayed along the horizontal axis, and the sound pressure level (SPL) expressed in dB of various maskers is shown along the vertical axis. A curve called the absolute masking threshold 210 represents the SPL at differing frequencies below which an average human ear cannot perceive. For example, an 11 KHz tone of 10 dB 214 lies below the absolute masking threshold 210 and thus cannot be heard by the average human ear. Absolute masking threshold 210 exhibits the fact that the human ear is most sensitive in the "speech range" of from 1 KHz to 5 KHz, and is increasingly insensitive at the extreme bass and extreme treble ranges.

Additionally, tones may be rendered unperceivable by the presence of another, louder tone at an adjacent frequency. The 2 KHz tone at 40 dB 218 makes it impossible to hear the 2.25 KHz tone at 20 dB 234, even though 2.25 KHz tone at 20 dB 234 lies above the absolute masking threshold 210. This effect is termed tone masking.

The extent of tone masking is experimentally determined. Curves known as spread functions show the threshold below which adjacent tones cannot be perceived. In FIG. 2, a 2 KHz tone at 40 dB 218 is associated with spread function 226. Spread function 226 is a continuous curve with a maximum point below the SPL value of 2 KHz tone at 40 dB 218. The difference in SPL between the SPL of 2 KHz tone at 40 dB 218 and the maximum point of corresponding spread function 226 is termed the offset of spread function 226. The spread function will change as a function of SPL and frequency. As an example, 2 KHz tone at 30 dB 222 has associated spread function 230, with a differing shape compared with spread function 226.

In addition to masking caused by tones, noise signals having a finite bandwidth may also mask out nearby sounds. For this reason the term masker will be used when necessary as a generic term encompassing both tone and noise sounds which have a masking effect. In general the effects are similar, and the following discussion may specify tone masking as an example. But it should be remembered that, unless otherwise specified, the effects discussed apply equally to noise sounds and the resulting noise masking.

The utility of the absolute masking threshold 210, and the spread functions 226 and 230, is in aiding bit allocator 130 to allocate bits to maximize both compression and fidelity. If the tones of FIG. 2 were required to be encoded by MPEG audio encoder 100, then allocating any bits to the sub-band containing 11 KHz tone of 10 dB 214 would be pointless, because 11 KHz tone of 10 dB 214 lies below absolute masking threshold 210 and would not be perceived by the human ear. Similarly allocating any bits to the sub-band containing 2.25 KHz tone of 20 dB 234 would be pointless because 2.25 KHz tone of 20 dB 234 lies below spread function 226 and would not be perceived by the human ear. Thus, knowledge about what may or may not be perceived by the human ear allows efficient bit allocation and resulting data compression without sacrificing fidelity.

Figure 3A:
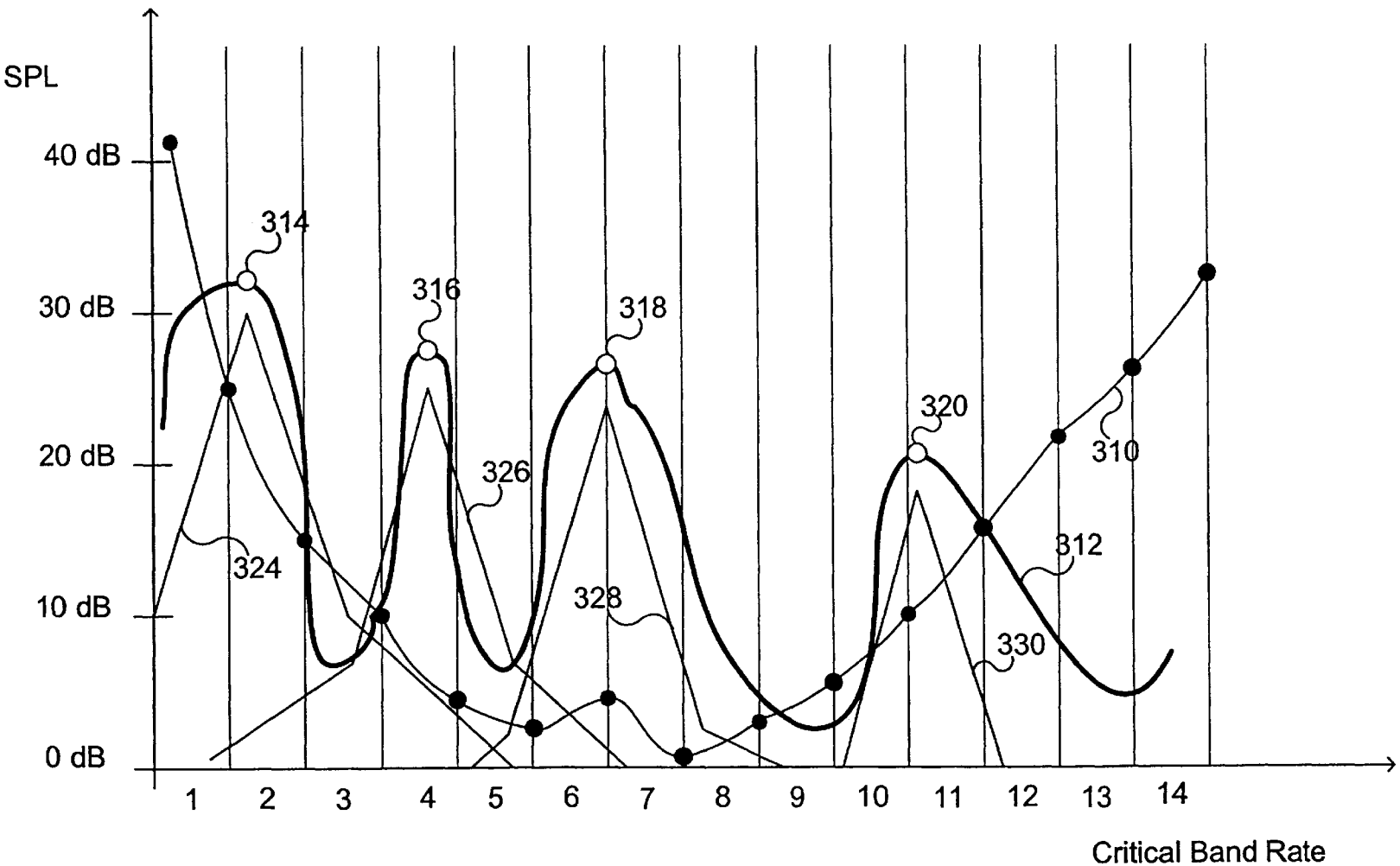
FIGS. 3A and 3B are graphs showing a derivation of the global masking threshold.
Figure 3B:
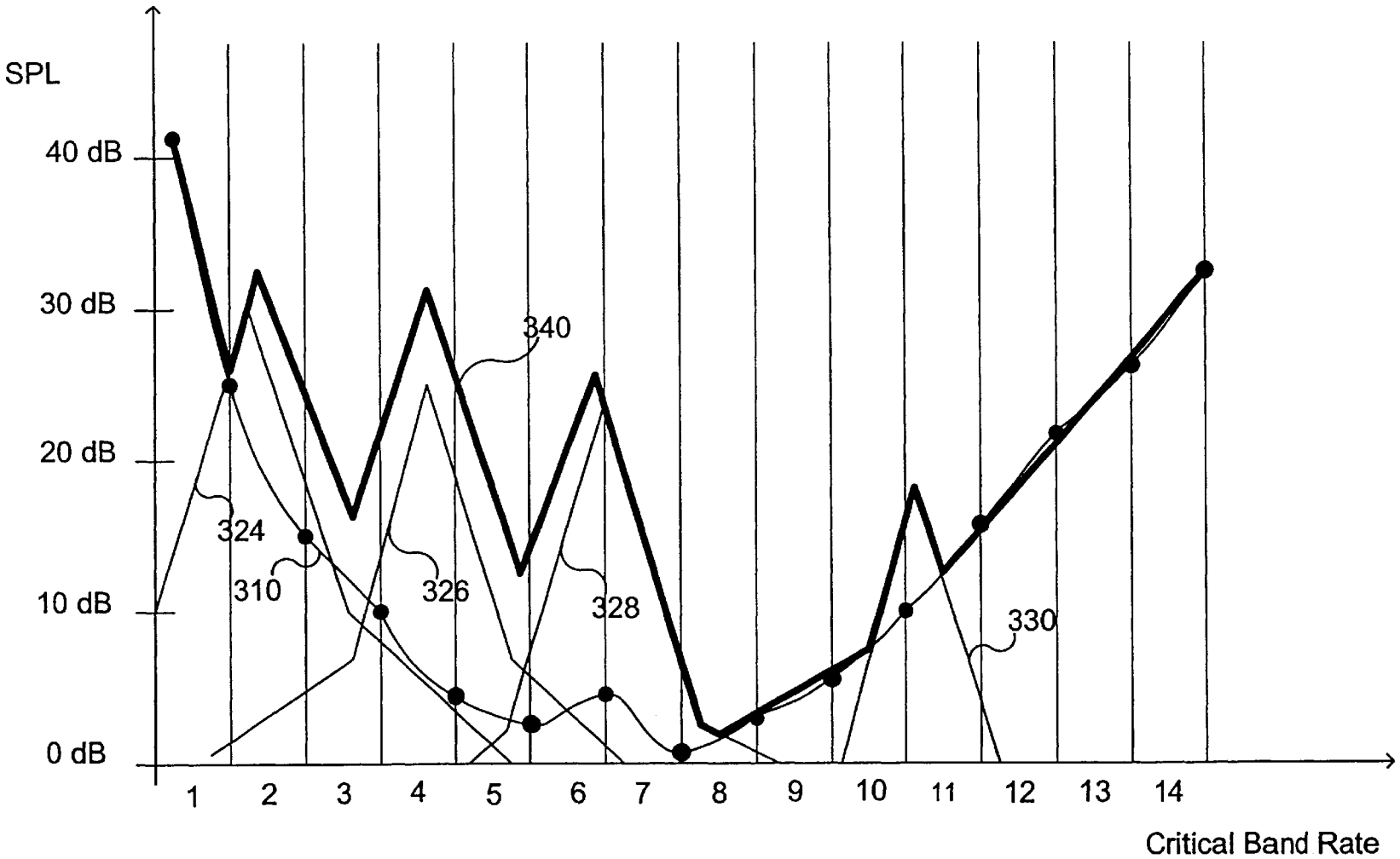

Referring now to FIGS. 3A and 3B, graphs illustrating a derivation of the global masking threshold are shown. The frequency allocation of the critical bands is displayed across the horizontal axis measured in Barks, and the sound pressure level (SPL) expressed in dB of various maskers is shown along the vertical axis. For the purpose of illustrating the present invention, FIGS. 3A, 3B, 4, and 5 only show 14 critical bands. However, in reality there are 25 critical bands measured in psycho-acoustic theory. Similarly, for the purpose of illustration, the frequency domain representation 312 is shown in a very simplified form as a continuous curve with few minimum and maximum points. In actual use, the frequency domain representation 312 would typically be a series of disconnected points with many more minimum and maximum values.

In the preferred embodiment, the psycho-acoustic modeler 122 comprises a digital signal processing (DSP) microprocessor (not shown in FIG. 1). In alternate embodiments other digital processors may be used. The psycho-acoustic modeler manager 124 of psycho-acoustic modeler 122 runs on the DSP. The psycho-acoustic modeler 122 converts the LPCM audio from the original time domain to the frequency domain by performing a fast-Fourier transform (FFT) on the LPCM audio. In alternate embodiments, other methods may be used to derive the frequency domain representation of the LPCM audio. The frequency domain representation 312 of the LPCM audio is shown as a curve on FIG. 3A to represent the power spectral density (PSD) of the LPCM audio.

The psycho-acoustic modeler manager 124 then determines the tonal components for masking threshold computation by searching for the maximum points of frequency domain representation 312. The process of determining the tonal components is described in detail in conjunction with FIG. 8 below. In the FIG. 3A example, determining the maximum points of frequency domain representation 312 yields first tonal component 314, second tonal component 316, and third tonal component 318. Noise components are determined differently. After the tonal components are identified, the remaining signals in each critical band are integrated. A noise component is identified if sufficient non-tonal signal strength is found in a critical band. For the purpose of illustration, FIG. 3A assumes sufficient non-tonal signal strength is found in critical band 11, and identifies noise component 320. The psycho-acoustic modeler manager 124 next compares the identified masking components with the absolute masking threshold 310.

Next psycho-acoustic modeler manager 124 eliminates any smaller tonal components within a range of 0.5 Bark from each tonal component (not shown in the FIG. 3A example). This step is known as decimation. Psycho-acoustic modeler manager 124 then determines the spread functions corresponding to the masking components 314, 316, 318, and 320. The spread functions derived from experiment are complex curves. In the preferred embodiment, the spread functions are represented for memory storage and computational efficiency by a four segment piecewise linear approximation. These four segment piecewise linear approximations may be characterized by an offset and by the slopes of the segments. In the FIG. 3A example, masking components 314, 316, 318, and 320 are associated with piecewise linear spread functions 324, 326, 328, and 330, respectively.

Starting with the individual piecewise linear spread functions 324, 326, 328, and 330 of FIG. 3A, FIG. 3B shows a derivation of the global masking threshold 340. In FIG. 3B, because the individual spread functions are expressed in dB, the psycho-acoustic modeler 122 adds the values of the individual piecewise linear spread functions 324, 326, 328, and 330 together. The psycho-acoustic modeler manager 124 compares the resulting sum with absolute masking threshold 310, and selects the greater of the sum and the absolute masking threshold 310 as the global masking threshold 340.

Figure 4:
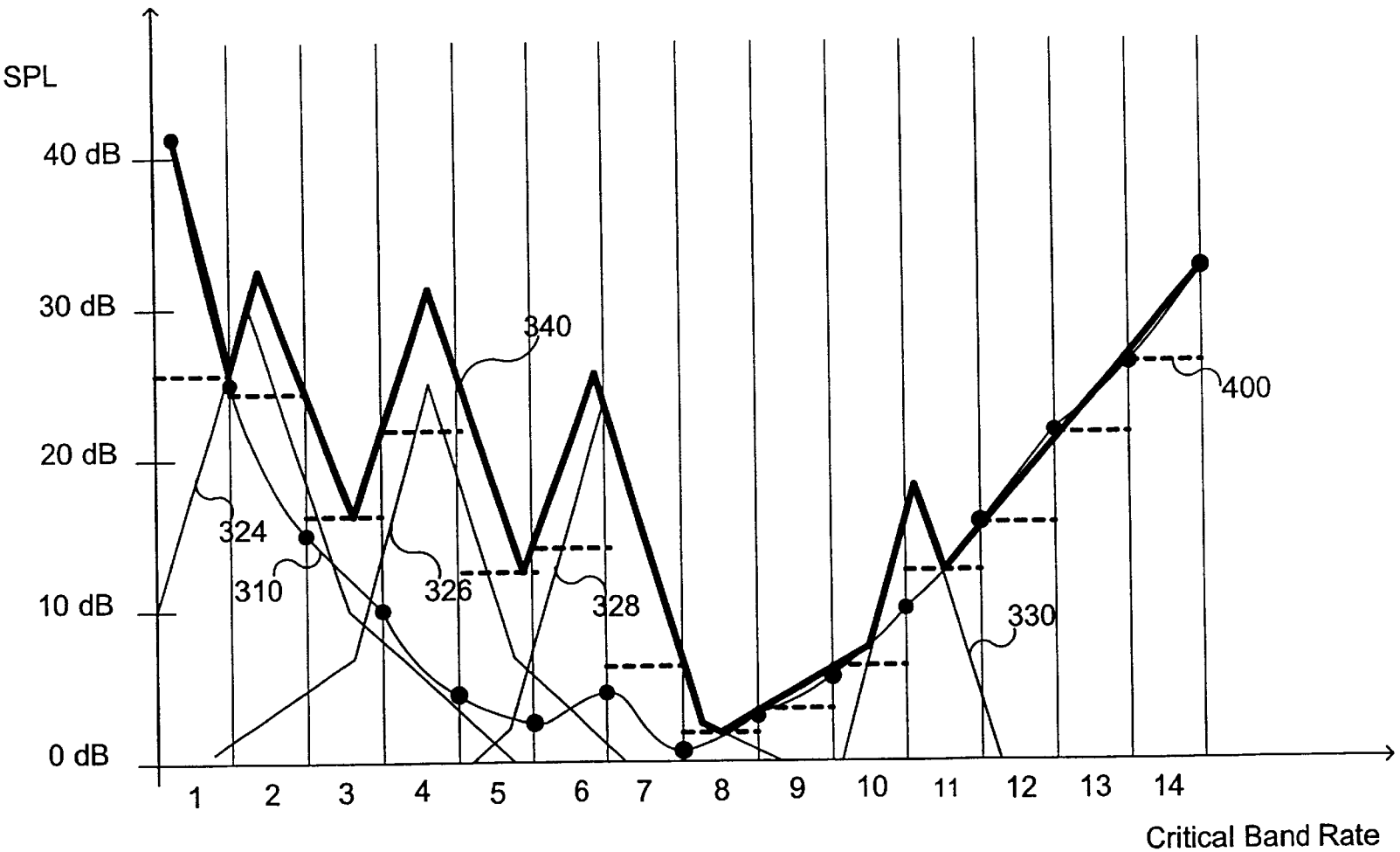
FIG. 4 is a graph showing a derivation of the minimum masking threshold.

Referring now to FIG. 4, a graph illustrating a derivation of the minimum masking threshold is shown. The frequency allocation of the critical bands is displayed across the horizontal axis measured in Barks, and the sound pressure level (SPL) expressed in dB of various maskers is shown along the vertical axis. Psycho-acoustic modeler manager 124 examines the global masking threshold 340 in each critical band. The psycho-acoustic modeler manager 124 determines the minimum value of the global masking threshold 340 in each critical band. These minimum values determine a new step function, called the minimum masking threshold 400, whose values are the minimum values of the global masking threshold 340 in each critical band. Minimum masking threshold 400 serves as the mask-to-noise ratio (MNR). Once minimum masking threshold 400 is determined, psycho-acoustic modeler manager 124 transfers minimum masking threshold 400 via threshold signal output 126 for use by bit allocator 130.

In the following description several variables will be discussed which are expressed both in linear and in decibel (dB) form. For the purpose of consistency, variables expressed in linear (non-logarithmic) form will be designated with capital letters and variables expressed in decibel (logarithmic) form will be designated with lower-case letters.

In the usual process of deriving the minimum masking threshold, because the individual masking function components are expressed in dB, the individual masking function at critical band rate z(i), denoted $lt_{tm}[z(j), z(i)]$, may be calculated as the sum of the intensity of the tonal component $x_{tm}[z(j)]$ at critical band rate z(j), the offset from this intensity given by a mask index function $av_{tm}[z(j)]$, and a spread function $vf[x_{tm}[z(j)], dz]$:

$$lt_{tm}[z(j), z(i)]=x_{tm}[z(j)]+av_{tm}[z(j)]+vf[x_{tm}[z(j)], dz] \quad \text{Equation 1A}$$

Here dz is defined as dz=z(i)−z(j). For the cases where the identified sound is not a tone but rather a non-tonal sound (e.g. narrowband noise), the non-tonal mask index is different than the tonal mask index, so the individual masking function for a non-tonal sound is given by an analogous equation:

$$lt_{nm}[z(j), z(i)]=x_{nm}[z(j)]+av_{nm}[z(j)]+vf[x_{nm}[z(j)], dz] \quad \text{Equation 1B}$$

In both Equations 1A and 1B the components could be summed because they are expressed logarithmically in dB. The functions av and vf are easy to express in dB because they are either linear functions or piecewise linear functions when expressed in dB. However, the intensities of the masking components x, expressed in dB, are not known beforehand, and must be determined by taking the base—10 logarithm of the measured sound intensity X, expressed linearly, as follow:

$$x_{tm}[z(j)]=10\ \log(X_{tm}[z(j)]) \quad \text{Equation 2A}$$

$$X_{nm}[z(j)]=10\ \log(X_{nm}[z(j)]) \quad \text{Equation 2B}$$

The functions expressed in Equations 2A and 2B are expressed in dB. The factor of 10 appears because a decibel (dB) is $1/10^{th}$ of a Bel.

When calculations are performed in dB, for every individual masking component at z(j), an intensity value of x[z(j)] must be obtained in accordance with Equation 2A or 2B. These values may be obtained by direct calculation of a series expansion for the logarithm function, or by using a look-up table. Neither method is efficient when implemented in assembly language running on a DSP. The calculation of transcendental functions, such as logarithms, would require a large amount of DSP computation power. Similarly, a look-up table containing the logarithms of all allowed intensity values would require a very large amount of non-volatile memory. In addition, circumstances may require taking the anti-logarithm of the sums derived in Equations 1A and 1B in other parts of the psycho-acoustic calculations.

The present invention eliminates the requirement for obtaining the logarithms of X[z(j)] by recasting the logarithmic expression of the masking component, and the summation of the components expressed in dB, shown in Equations 1A and 1B, into linear expressions $LT_{tm}$ and $LT_{nm}$. These linear expressions are the products of components, as shown below in Equations 3A and 3B.

$$LT_{tm}[z(j), z(i)]=X_{tm}[z(j)]*AV_{tm}[z(j)]*VF[X_{tm}[z(j)], dz] \quad \text{Equation 3A}$$

$$LT_{nm}[z(j), z(i)]=X_{nm}[z(j)]*AV_{nm}[z(j)*VF[X_{nm}[z(j)], dz] \quad \text{Equation 3B}$$

In Equations 3A and 3B, the X[z(j)] values are the as-measured values of the strengths of the masking components, and require no further manipulation. The AV[z(j)] are related to the av[z(j)] of Equations 1A and 1B by Equations 4A and 4B below.

$$av_{tm}[z(j)]=10\ \log(AV_{tm}[z(j)]) \quad \text{Equation 4A}$$

$$av_{nm}[z(j)]=10\ \log(AV_{nm}[z(j)]) \quad \text{Equation 4B}$$

In the preferred embodiment of the present invention, the linear expression VF[X[z(j)], dz] is represented as a product of factors F(dz) and G(X[z(j)], dz), as shown in Equation 5 below.

$$VF[X[z(j), dz]=F(dz)*G(X[z(j)], dz) \quad \text{Equation 5}$$

In this manner VF may be calculated as a product of a factor F which depends upon dz only, and a factor G which contains all the dependencies upon the signal strength X.

Figure 5:
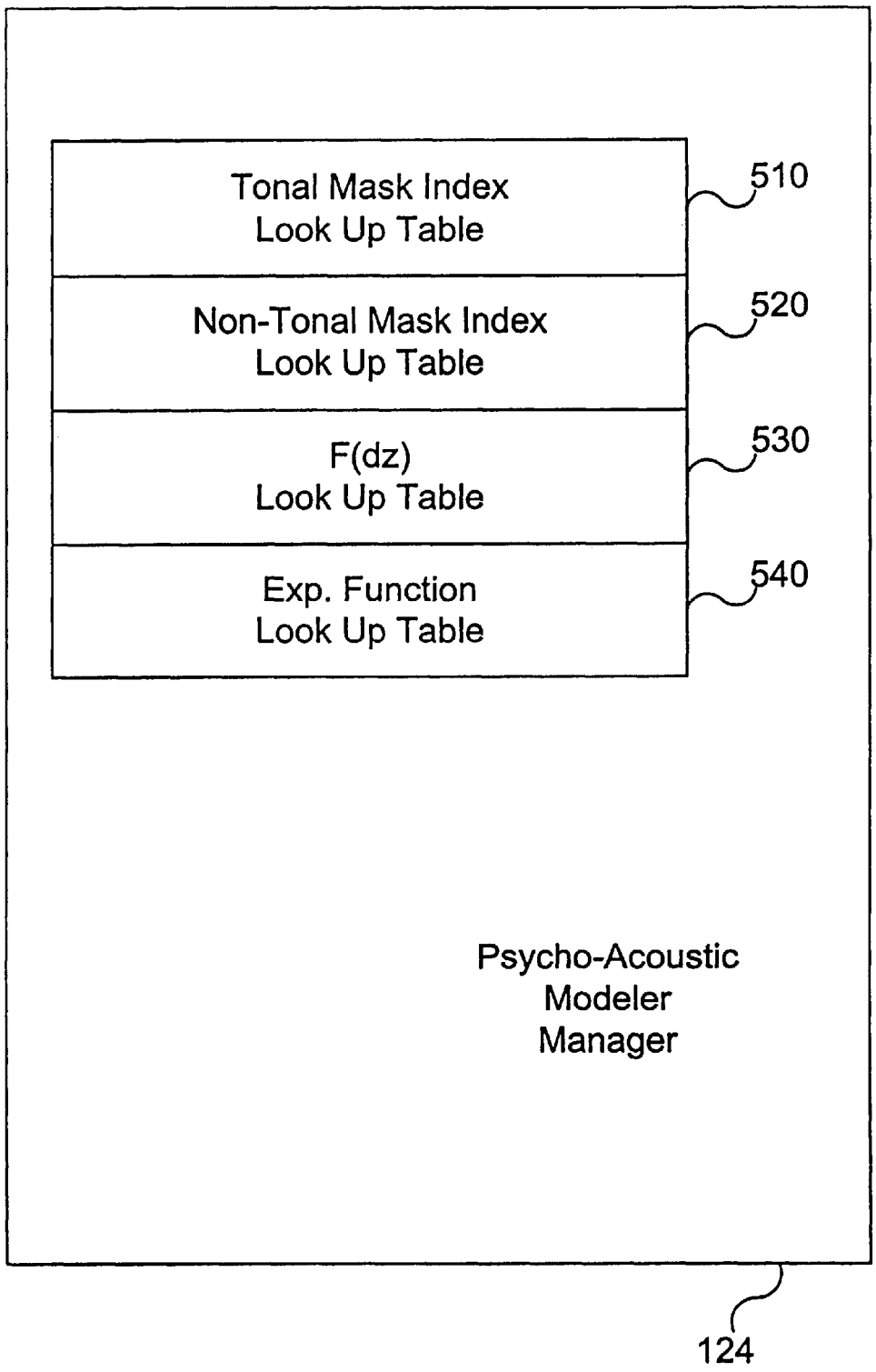
FIG. 5 is a memory map of the non-volatile memory of FIG. 1, in accordance with the present invention.

Referring now to FIG. 5, a memory map of the non-volatile memory of FIG. 1 is shown, in accordance with the present invention. In the preferred embodiment of the present invention, psycho-acoustic modeler manager 124 includes four relatively small-sized look-up tables. These look-up tables are sufficient to provided the values needed to calculate AV and VF in support of deriving the individual masking thresholds LT (refer to Equations 3A and 3B above). Tone mask index look-up table 510 contains values corresponding to required values of $AV_{tm}[z(j)]$. Non-tonal mask index look-up table 520 contains values corresponding to required values of AVnm[z(j)]. F(dz) look-up table contains that factor of VF which depends upon dz only.

There is no corresponding look-up table for G(X[z(j)], dz), because G(X[z(j)], dz) depends upon two variables. Such a look-up table would be prohibitively large in size. Instead, G(X[z(j)], dz) is calculated using predominantly additions and multiplications. At one step in the calculation of G(X[z(j)], dz) an exponential function of the base e (the base of natural logarithms) is required. Therefore, in the preferred embodiment psycho-acoustic modeler manager 124 includes an exponential function look-up table 540 over a range which supports the calculation of G(X[z(j)], dz).

When the psycho-acoustic modeler manager 124 contains the preferred embodiment look-up tables 510, 520, 530, and 540, psycho-acoustic modeler manager 124 may calculate the individual thresholds $LT_{tm}$ and $LT_{nm}$ as shown in Equations 3A and 3B. Once the individual thresholds $LT_{tm}$ and $LT_{nm}$ are calculated, they may be combined through multiplication to derive the minimum masking threshold in a manner analogous to that discussed in FIGS. 3B and 4 above for individual thresholds expressed in dB.

Figure 6B:
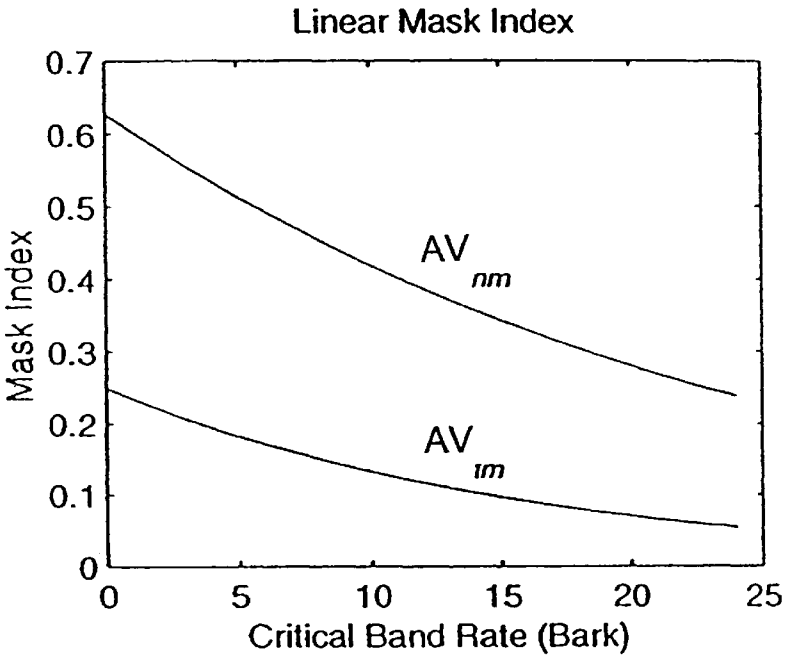
FIG. 6B is a graph showing a mask index expressed linearly, in accordance with the present invention
Figure 6A:
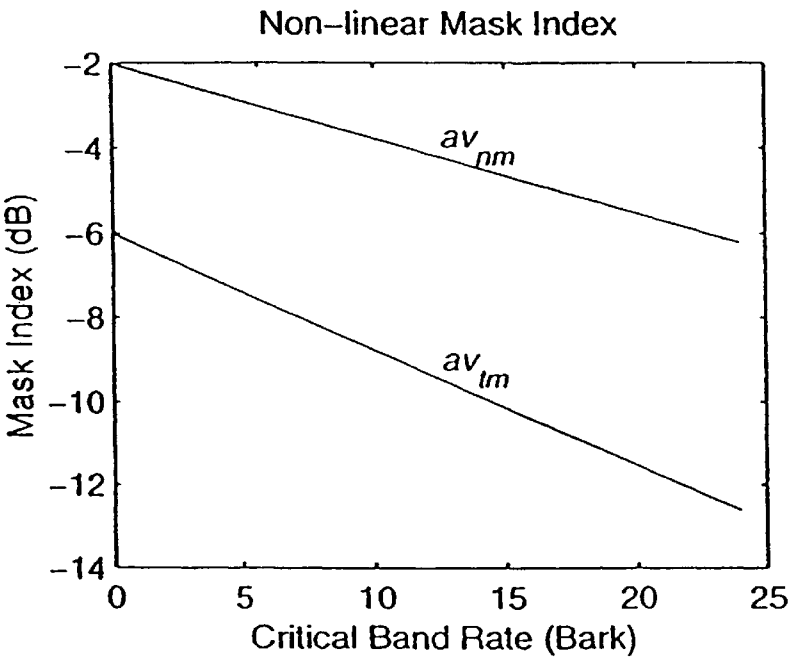
FIG. 6A is a graph showing a mask index expressed in dB.

Referring now to FIGS. 6A and 6B, graphs show a mask index expressed in dB and linearly, respectively, in accordance with the present invention. FIG. 6A shows a typical pair of mask index functions $av_{tm}$ and $av_{nm}$ which are lines when expressed in dB. From these mask index functions is derived the mask index functions $AV_{tm}[z(j)]$ and $AV_{nm}[z(j)]$ expressed linearly, in accordance with Equations 4A and 4B.

Figure 7A:
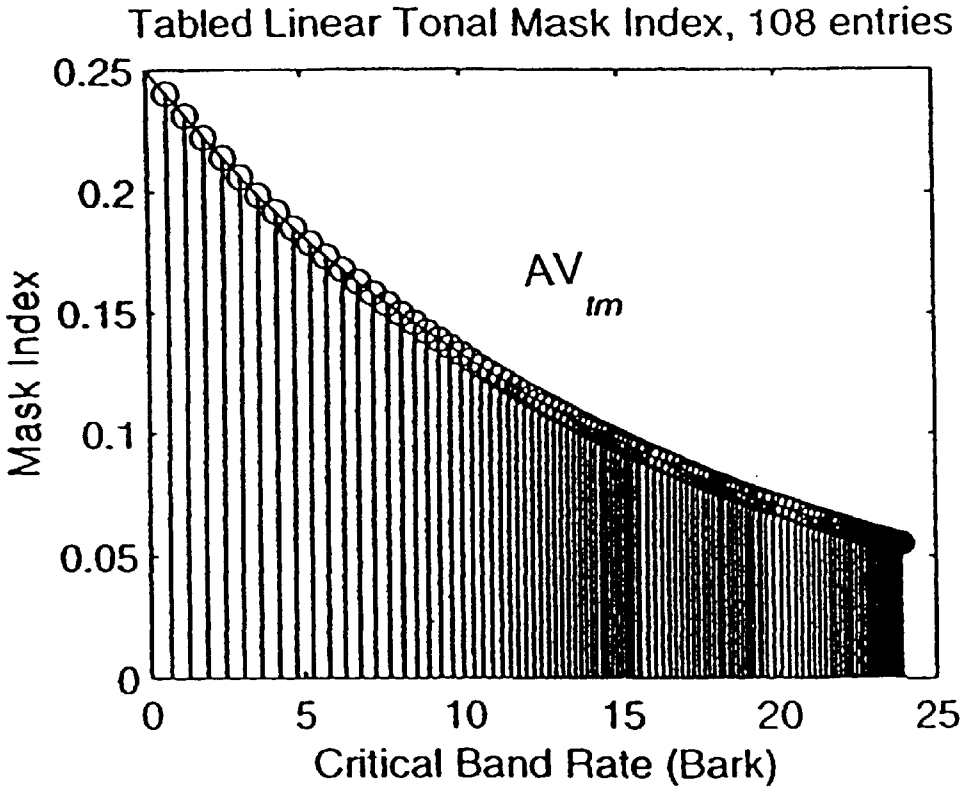
FIG. 7A is a graph showing a derivation of the entries in a look-up table for a linear tonal mask index, in accordance with the present invention.
Figure 7B:
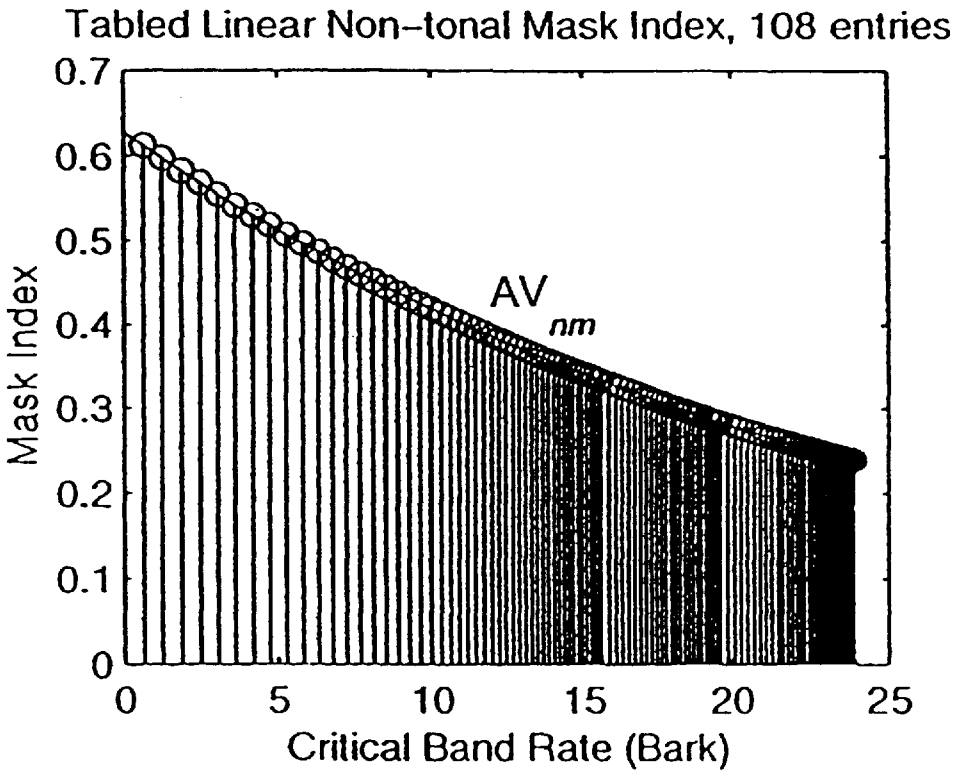
FIG. 7B is a graph showing a derivation of the entries in a look-up table for a linear non-tonal mask index, in accordance with the present invention.

Referring now to FIGS. 7A and 7B, graphs show a derivation of the entries in the look-up tables for a linear tonal mask index and linear non-tonal mask index, respectively, in accordance with the present invention. FIG. 7A shows the derivation of the entries in the tonal mask index look-up table 510. In the preferred embodiment, 108 entry values are stored in tonal mask index look-up table 510. The entries are not evenly spaced and are spaced closer together at higher Bark values of z(j). In alternate embodiments other range spacings could be used, either evenly spaced or some other non-evenly spacing. FIG. 7B shows the similar derivation of the entries in the non-tonal mask index look-up table 520. In either case the mask index may be extracted when the critical band rate of the masker z(j) is known.

The spread function vf[x[z(j)], dz] as used in Equations 1A and 1B is shown in pictorial manner in FIGS. 3A, 3B, and 4 as a four segment piecewise linear function when expressed in dB. An exemplary arithmetic version of vf[x[z(j)], dz] is given below by Equations 6A through 6D:

$$vf=17(dz+1)-(0.4x[z(j)]+6);\ -3\leqq dz<-1 \text{ Bark} \quad \text{Equation 6A}$$

$$vf=(0.4x[z(j)]+6)dz;\ -1\leqq dz<0 \text{ Bark} \quad \text{Equation 6B}$$

$$vf=-17dz;\ 0\leqq dz<1 \text{ Bark} \quad \text{Equation 6C}$$

$$vf=-(dz-1)(17-(0.15x[z(j)])-17;\ 1\leqq dz<8 \text{ Bark} \quad \text{Equation 6D}$$

The linear expression for vf, VF[x[z(j)], dz) is defined in Equation 7 below.

$$vf=10\log(VF) \quad \text{Equation 7}$$

Substituting the definition of Equation 7 into Equations 6A through 6D yields exemplary linear expressions for VF:

$$VF=(10^{(1.1)}10^{(1.7dz)})(X[z(j)]^{(-0.4dz)}) \quad \text{Equation 8A}$$

$$VF=(10^{(0.6dz)})(X[z(j)]^{(0.4dz)}) \quad \text{Equation 8B}$$

$$VF=(10^{(-1.7dz)}) \quad \text{Equation 8C}$$

$$VF=(10^{(-1.7dz)})(X[z(j)]^{(0.15(dz-1))}) \quad \text{Equation 8D}$$

where the ranges of dz are the same as the corresponding Equation 6A through 6D, and the variable X[z(j)] is as given below in Equation 9.

$$X[z(j)]=10^{(x[z(j)]/10)} \quad \text{Equation 9}$$

Comparing Equation 5 with Equations 8A through 8D, the first factor in Equations 8A through 8D corresponds to F(dz) and the second factor in Equations 8A through 8D corresponds to G(X[z(j)], dz). In Equation 8C note that G=1.

Figure 8:
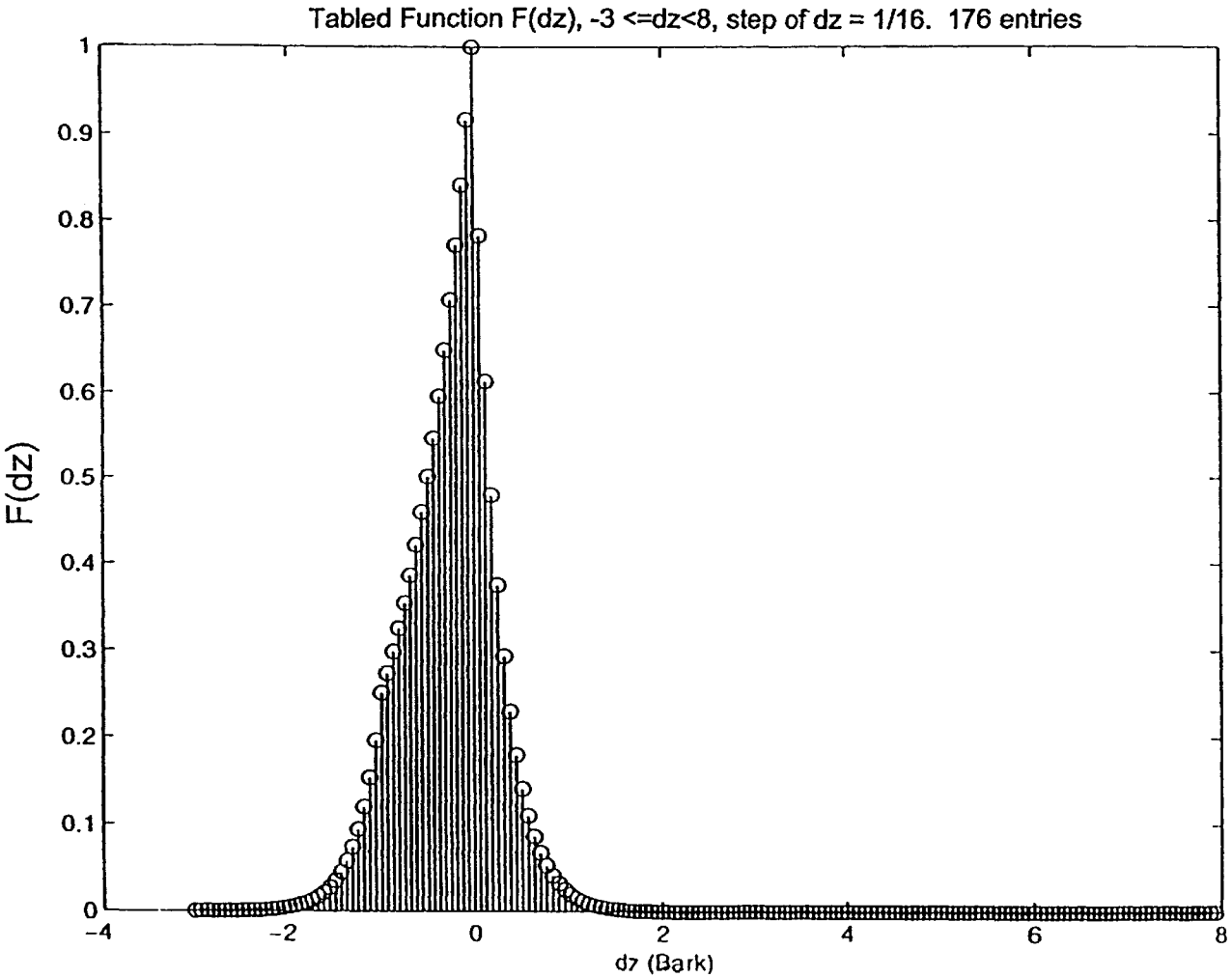
FIG. 8 is a graph showing a derivation of the entries in the F(dz) look-up table for the masker-component-intensity independent factor of the spread function, in accordance with the present invention.

Referring now to FIG. 8, a graph showing a derivation of the entries in the F(dz) look-up table 510 for the masker-component-intensity independent factor of the spread function VF, in accordance with the present invention. In the preferred embodiment of the present invention, the values of F(dz) are taken from Equations 8A through 8D above. These values are calculated once and then stored in the F(dz) look-up table 510 representing range values of dz spaced $1/16^{th}$ Bark apart. With a total range of 11 Barks, a total of 176 calculated values of F(dz) are stored.

Figure 9:
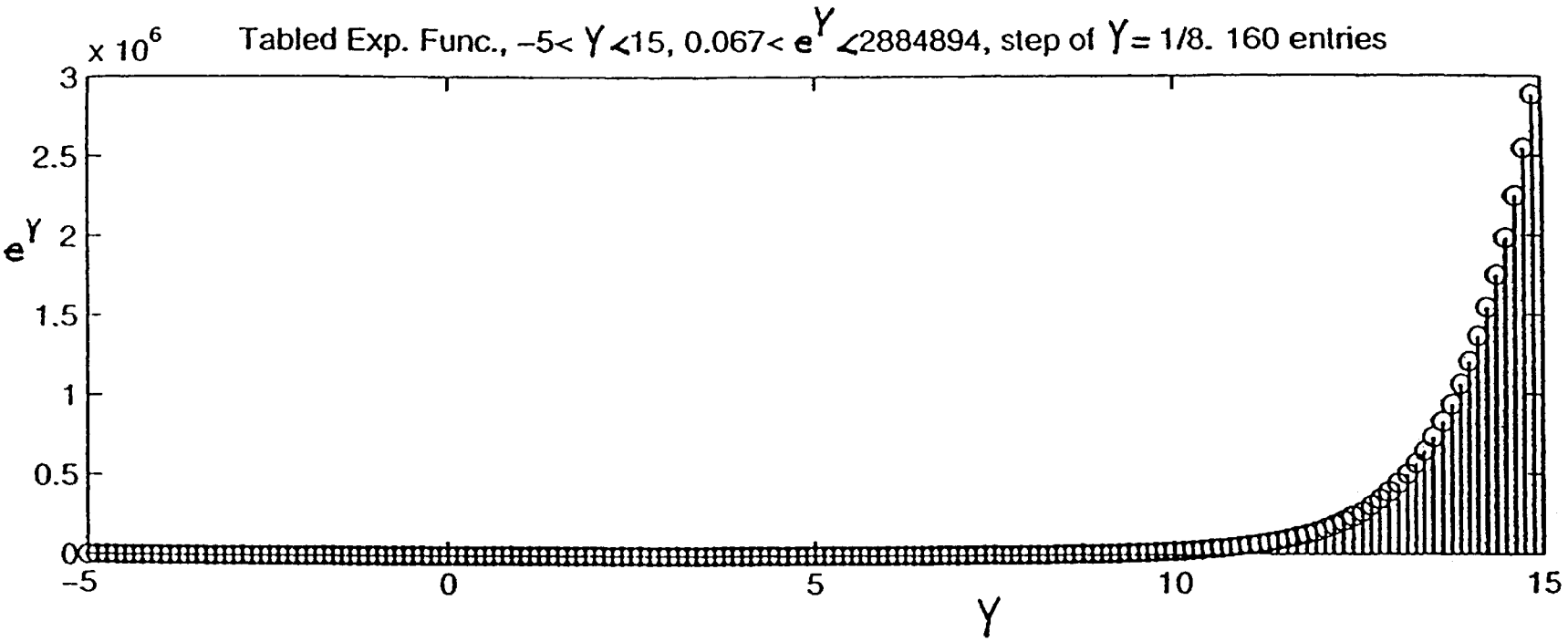
FIG. 9 is a graph showing a derivation of the entries in the exponential function look-up table used in the derivation of the masker-component-intensity dependent factor G(X[z (j))], dz), in accordance with the present invention.

Referring now to FIG. 9, a graph shows a derivation of the entries in the exponential function look-up table 540 used in the derivation of the masker-component-intensity dependent factor G(X[z(j)], dz), in accordance with the present invention. In the preferred embodiment of the present invention, the values of G(X[z(j)], dz) are taken from Equations 8A through 8D above. However, rather than use a look-up table, the values of G(X[z(j)], dz) are calculated in a three step process. The natural logarithms of G(X[z(j)], dz) are logically taken, then the natural logarithms are calculated using a series expansion, and then finally the anti-logarithm is derived using the exponential function look-up table 540. For the purpose of illustration the function G(X[z(j)], dz) for the range $-1\leqq dz\leqq 0$ is derived using the exemplary function identified in Equation 8B. The same method is used to derive G(X[z(j)], dz) for other ranges of dz.

Equations 5 and 8B yield an exemplary function of G(X[z(j)], dz).

$$G(X[z(j)],\ dz)=(X[z(j)]^{(0.4dz)}) \quad \text{Equation 10}$$

Taking the natural logarithms of both sides, and setting X equal to a product of a scale factor S and a variable W, $$1n\ G(X[z(j)],\ dz)=1n(X[z(j)]^{(0.4dz)})=1n(S\ W)^{(0.4dz)} \quad \text{Equation 11A}$$

$$1n\ G(X[z(j)],\ dz)=0.4dz(1n\ S+1n\ W) \quad \text{Equation 11B}$$

The scale factor S is represented by $2^l$, $$1n\ G(X[z(j)],\ dz)=0.4dz(1n\ 2^l+1n\ W) \quad \text{Equation 11C}$$

$$1n\ G(X[z(j)],\ dz)=0.4dz(l\ 1n(2)+1n\ W) \quad \text{Equation 11D}$$

The scale factor S is chosen to shift the variable W to have the range of $1\leqq W\leqq 2$, so that the series expansion for W may be used for calculating G. The series expansion approximation for 1n W is given in Equation 12.

$$\begin{aligned}\ln W = {} & 0.9991150(W-1)-0.4899597(W-1)^2+ \\ & 0.2856751(W-1)^3-0.1330566(W-1)^4+ \\ & 0.03137207(W-1)^5\end{aligned} \quad \text{Equation 12}$$

Substituting the series expansion approximation of Equation 12 into Equation 11D, $$\begin{aligned}\ln G(X[z(j)],\ dz) = {} & 0.4dz(l\ln(2))+ \\ & 0.9991150(W-1)- \\ & 0.4899597(W-1)^2+ \\ & 0.2856751(W-1)^3+ \\ & 0.1330566(W-1)^4+ \\ & 0.03137207(W-1)^5\end{aligned} \quad \text{Equation 13}$$

Notice that the right hand side of Equation 13 contains nothing but simple arithmetic combinations of the variables X[z(j)] and dz, and several constants. Thus the right hand side of Equation 13 may be efficiently calculated using a DSP using assembly language.

Once the value of In G(X[z(j)], dz) is calculated, G(X[z(j)], dz) may be derived by exponential function look-up table 540. The values of the exponential function look-up table 540 are taken from a standard reference table. The range of values of In G(X[z(j)], dz) have been experimentally determined to be between −5 and 15. Similarly the range values of 1n G(X[z(j)], dz) have been spaced ⅛ unit apart, a separation value which was experimentally determined.

Figure 10:
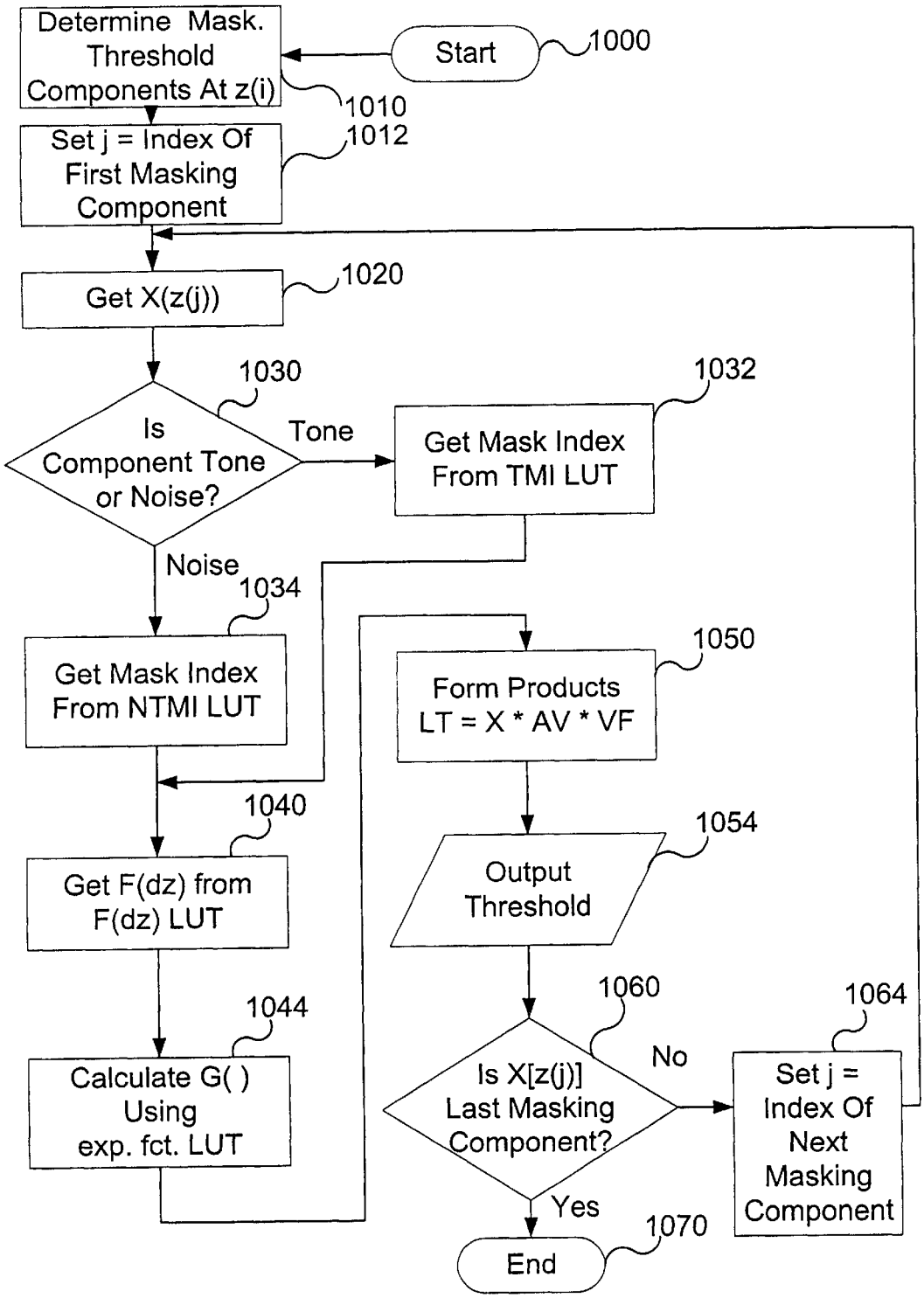
FIG. 10 is a flowchart of preferred method steps for implementing an individual masking function in a psycho-acoustic modeler, in accordance with the present invention.

Referring now to FIG. 10, a flowchart of preferred method steps for implementing an individual masking function in a psycho-acoustic modeler is shown, in accordance with the present invention. Psycho-acoustic modeler 122 periodically sends overall masking information, in the form of minimum masking threshold 400, to bit allocator 130. The psycho-acoustic modeler manager 124 periodically calculates minimum masking threshold 400 for psycho-acoustic modeler 122. When it is time to calculate minimum masking threshold 400, at step 1000, the process of FIG. 10 begins. In step 1010, psycho-acoustic modeler manager 124 determines the set, indexed by i, of tone and noise masking components at critical band rate z(i). Then in step 1012, index j is set to the index of the first masking component z(j) for masking function determination.

In the preferred embodiment of the present invention, in step 1020, the amplitude X(z(j)) of masking component at critical band rate z(j) is taken from the output of an FFT performed within psycho-acoustic modeler 122. In decision step 1030, psycho-acoustic modeler manager 124 determines whether the masking component is a tone masking component or a noise masking component. If the masking component at z(j) is a tone component, then the process exits from step 1030 along the "tone" branch. Then, in step 1032, psycho-acoustic modeler manager 124 retrieves the mask index value AV from the tonal mask index look-up table 510. If, however, the masking component at z(j) is a noise component, the process exits from step 1030 along the "noise" branch. Then, in step 1034, psycho-acoustic modeler manager 124 retrieves the mask index value AV from the non-tonal mask index look-up table 520.

After psycho-acoustic modeler manager 124 retrieves the appropriate value AV, then, in step 1040, psycho-acoustic modeler manager 124 determines the appropriate range of values of dz and retrieves the corresponding values of F(dz) from F(dz) look-up table 530. Next, in step 1044, psycho-acoustic modeler manager 124 calculates the values of 1n G(X[z(j)], dz) using Equation 13 and then retrieving the anti-logarithm G(X[z(j)], dz) from exponential function look-up table 540. Then as a final calculation, in step 1050, psycho-acoustic modeler manager 124 forms the individual masking threshold function LT by multiplying together the previously derived values of X, AV, and VF=F*G.

Once psycho-acoustic modeler manager 124 has calculated the individual masking threshold function LT, then in step 1064 this individual masking threshold function LT is transferred to another module within psycho-acoustic modeler manager 124. The individual masking threshold function LT may then be combined with other individual masking threshold functions and a linear form of absolute masking threshold 210 to create a linear form of minimum masking threshold 400.

In decision step 1060, psycho-acoustic modeler manager 124 determines if the current discrete frequency X[z(j)] represents the last masking component in the set. If so, then step 1060 exits along the "yes" branch and in step 1070 the process ends for this time period. If not, then step 1060 exits along the "no" branch and in step 1064 the value of j is set to the index of the next masking component. The steps of determining the individual masking threshold function LT are then repeated for the new X[z(j)].

The invention has been explained above with reference to a preferred embodiment. Other embodiments will be apparent to those skilled in the art in light of this disclosure. For example, the present invention may readily be implemented using configurations and techniques other than those described in the preferred embodiment above. Additionally, the present invention may effectively be used in conjunction with systems other than the one described above as the preferred embodiment. Therefore, these and other variations upon the preferred embodiments are intended to be covered by the present invention, which is limited only by the appended claims.

What is claimed is:

1. A system for efficiently determining a masking threshold to encode audio data, comprising:

a psycho-acoustic modeler that includes a modeler manager configured to determine said masking threshold by analyzing said audio data using one or more linear parameters that are stored in non-logarithmic form, and a microprocessor configured to control said modeler manager to thereby determine said masking threshold.

2. The system of claim 1 wherein a bit allocator in an audio encoder device receives said masking threshold from said psycho-acoustic modeler, and responsively encodes only selected portions of said audio data with energy values in excess of said masking threshold to thereby conserve audio encoding resources.

3. The system of claim 1 wherein said psycho-acoustic modeler is implemented in one of a digital versatile disc device, a consumer electronics device, a computer device, and an electronic audio device.

4. The system of claim 1 wherein said microprocessor is implemented as a digital signal processor device that executes said modeler manager to thereby determine said masking threshold.

5. The system of claim 1 wherein said linear parameters include at least one of a masking component intensity value, a non-logarithmic mask index value, and a non-logarithmic spread function value.

6. The system of claim 4 wherein said masking threshold is formed of a series of respective minimum values of a global masking threshold across a series of critical frequency bands of said audio data, said global masking threshold being equal to the sum of an absolute masking threshold and a series of individual piecewise linear spread functions that each correspond to at least one of an associated tonal component and an associated noise component.

7. The system of claim 1 wherein said psycho-acoustic modeler includes at least one of a non-logarithmic tonal mask-index lookup table, a non-logarithmic noise mask-index lookup table, an intensity-independent spread-function factor lookup table, and an exponential function lookup table for calculating an intensity-dependent spread-function factor.

8. The system of claim 1 wherein said modeler manager identifies a masking component in said audio data, said masking component having an intensity factor X, said masking component being one of a tonal component and a noise component.

9. The system of claim 8 wherein said modeler manager performs a Fast Fourier Transform on said masking component before determining said intensity value X corresponding to said masking component.

10. The system of claim 8 wherein said modeler manager determines a component type corresponding to said masking component, said component type including at least one of said tonal component and said noise component.

11. The system of claim 10 wherein said modeler manager references a non-logarithmic mask-index lookup table to determine a mask index value AV corresponding to said masking component.

12. The system of claim 10 wherein said modeler manager references a non-logarithmic tonal mask-index lookup table to determine said mask index value AV when said masking component is said tonal component.

13. The system of claim 10 wherein said modeler manager references a non-logarithmic noise mask-index lookup table to determine said mask index value AV when said masking component is said noise component.

14. The system of claim 11 wherein said modeler manager calculates a spread function value VF corresponding to said masking component.

15. The system of claim 14 wherein said spread function value VF may be expressed by a formula:

$$VF = \text{Factor } F * \text{Factor } G$$

where said Factor F is a masker-component intensity-independent factor that depends upon a component frequency of said masking component, and said Factor G is a masker-component intensity-dependent factor that depends upon said intensity value X of said masking component.

16. The system of claim 15 wherein said modeler manager determines Factor F by referencing a non-logarithmic intensity-independent factor lookup table.

17. The system of claim 15 wherein said modeler manager utilizes an exponential-function lookup table during a calculation procedure to determine said Factor G.

18. The system of claim 14 wherein said modeler manager determines said masking threshold according to a formula:

$$\text{Masking Threshold} = X * AV * VF$$

where said X is said intensity value X, said AV is said mask index value AV, and said VF is said spread function value VF.

19. The system of claim 18 wherein said modeler manager sequentially recalculates a different respective value for said masking threshold corresponding to each of said masking components from said audio data to thereby produce a total tonal masking threshold and a total noise masking threshold.

20. The system of claim 19 wherein said modeler manager combines said total tonal masking threshold and said total noise masking threshold to thereby produce a total combined masking threshold for use in encoding said audio data.

21. A method for efficiently determining a masking threshold to encode audio data, comprising the steps of:

determining said masking threshold with a modeler manager from a psycho-acoustic modeler by analyzing said audio data using one or more linear parameters that are stored in non-logarithmic form; and controlling said modeler manager with a microprocessor coupled to said psycho-acoustic modeler to thereby determine said masking threshold.

22. The method of claim 21 wherein a bit allocator in an audio encoder device receives said masking threshold from said psycho-acoustic modeler, and responsively encodes only selected portions of said audio data with energy values in excess of said masking threshold to thereby conserve audio encoding resources.

23. The method of claim 21 wherein said psycho-acoustic modeler is implemented in one of a digital versatile disc device, a consumer electronics device, a computer device, and an electronic audio device.

24. The method of claim 21 wherein said microprocessor is implemented as a digital signal processor device that executes said modeler manager to thereby determine said masking threshold.

25. The method of claim 21 wherein said linear parameters include at least one of a masking component intensity value, a non-logarithmic mask index value, and a non-logarithmic spread function value.

26. The method of claim 24 wherein said masking threshold is formed of a series of respective minimum values of a global masking threshold across a series of critical frequency bands of said audio data, said global masking threshold being equal to the sum of an absolute masking threshold and a series of individual piecewise linear spread functions that each correspond to at least one of an associated tonal component and an associated noise component.

27. The method of claim 21 wherein said psycho-acoustic modeler includes at least one of a non-logarithmic tonal mask-index lookup table, a non-logarithmic noise mask-index lookup table, an intensity-independent spread-function factor lookup table, and an exponential function lookup table for calculating an intensity-dependent spread-function factor.

28. The method of claim 21 wherein said modeler manager identifies a masking component in said audio data, said masking component having an intensity factor X, said masking component being one of a tonal component and a noise component.

29. The method of claim 28 wherein said modeler manager performs a Fast Fourier Transform on said masking component before determining said intensity value X corresponding to said masking component.

30. The method of claim 28 wherein said modeler manager determines a component type corresponding to said masking component, said component type including at least one of said tonal component and said noise component.

31. The method of claim 30 wherein said modeler manager references a non-logarithmic mask-index lookup table to determine a mask index value AV corresponding to said masking component.

32. The method of claim 30 wherein said modeler manager references a non-logarithmic tonal mask-index lookup table to determine said mask index value AV when said masking component is said tonal component.

33. The method of claim 30 wherein said modeler manager references a non-logarithmic noise mask-index lookup table to determine said mask index value AV when said masking component is said noise component.

34. The method of claim 31 wherein said modeler manager calculates a spread function value VF corresponding to said masking component.

35. The method of claim 34 wherein said spread function value VF may be expressed by a formula:

$$VF = \text{Factor } F * \text{Factor } G$$

where said Factor F is a masker-component intensity-independent factor that depends upon a component frequency of said masking component, and said Factor G is a masker-component intensity-dependent factor that depends upon said intensity value X of said masking component.

36. The method of claim 35 wherein said modeler manager determines Factor F by referencing a non-logarithmic intensity-independent factor lookup table.

37. The method of claim 35 wherein said modeler manager utilizes an exponential-function lookup table during a calculation procedure to determine said Factor G.

38. The method of claim 34 wherein said modeler manager determines said masking threshold according to a formula:

$$\text{Masking Threshold}=X*AV*VF$$

where said X is said intensity value X, said AV is said mask index value AV, and said VF is said spread function value VF.

39. The method of claim 38 wherein said modeler manager sequentially recalculates a different respective value for said masking threshold corresponding to each of said masking components from said audio data to thereby produce a total tonal masking threshold and a total noise masking threshold.

40. The method of claim 39 wherein said modeler manager combines said total tonal masking threshold and said total noise masking threshold to thereby produce a total combined masking threshold for use in encoding said audio data.

41. A computer-readable medium containing program instructions for efficiently determining a masking threshold by performing the steps of:

determining said masking threshold with a modeler manager from a psycho-acoustic modeler by analyzing audio data using one or more linear parameters that are stored in non-logarithmic form; and controlling said modeler manager with a microprocessor coupled to said psycho-acoustic modeler to thereby determine said masking threshold.

42. A system for efficiently determining a masking threshold to encode audio data, comprising:

means for determining said masking threshold by analyzing said audio data using one or more linear parameters; and means for controlling said means for determining said masking threshold.

* * * * *